United States Patent [19]

Grossmann et al.

[11] 4,392,185

[45] Jul. 5, 1983

[54] EXPLOSION-PROOF AND FIREDAMP-PROOF HEADLIGHT

[75] Inventors: Karl Grossmann, Hünxe; Robert Mullejans, Mülheim, both of Fed. Rep. of Germany

[73] Assignee: Friemann & Wolf GmbH, Duisburg, Fed. Rep. of Germany

[21] Appl. No.: 197,999

[22] PCT Filed: Mar. 1, 1980

[86] PCT No.: PCT/DE80/00023

§ 371 Date: Nov. 14, 1980

§ 102(e) Date: Oct. 10, 1980

[87] PCT Pub. No.: WO80/01944

PCT Pub. Date: Sep. 18, 1980

[30] Foreign Application Priority Data

Mar. 14, 1979 [DE] Fed. Rep. of Germany ..... 2909965

[51] Int. Cl.[3] ..... F21L 15/14

[52] U.S. Cl. ..... 362/105; 362/157; 362/183; 362/199; 339/111; 361/2; 361/56; 361/91

[58] Field of Search ..... 362/88, 105, 106, 157, 362/164, 183, 199; 361/2, 91, 56; 307/150, 157; 339/111

[56] References Cited

U.S. PATENT DOCUMENTS

| | | | |
|---|---|---|---|
| 2,475,578 | 7/1949 | Halstead | 362/88 |
| 2,987,718 | 6/1961 | Davis | 362/183 |
| 3,051,831 | 8/1962 | Grieger | 362/183 |
| 3,070,748 | 12/1962 | Worobey | 362/183 |
| 3,408,490 | 10/1968 | Lozeau | 362/183 |
| 3,723,947 | 3/1973 | Lozeau | 339/91 R |
| 3,828,201 | 8/1974 | Allen | 362/105 |
| 4,317,162 | 2/1982 | Richards | 362/183 |

*Primary Examiner*—Donald P. Walsh

*Attorney, Agent, or Firm*—Karl F. Ross; Herbert Dubno

[57] ABSTRACT

The present invention refers to an explosion and/or firedamp proof headlight consisting of a headpiece, a connecting cable, a battery housing provided with a plurality of replaceable accumulators and connecting means for additional electrically operated attachments as measuring instruments, radio communication equipment, etc.

To provide an outlet for any desired and interchangeably attachable supplementary, electrically operated equipment, an additional self-regulated safety battery is incorporated in the battery housing and connected with a plug receptacle installed on said housing, so that beside the electric circuit of the accumulators feeding the headlights, there is in the same battery housing an independent safety circuit available for the operation of said additional electrical equipment.

5 Claims, 1 Drawing Figure

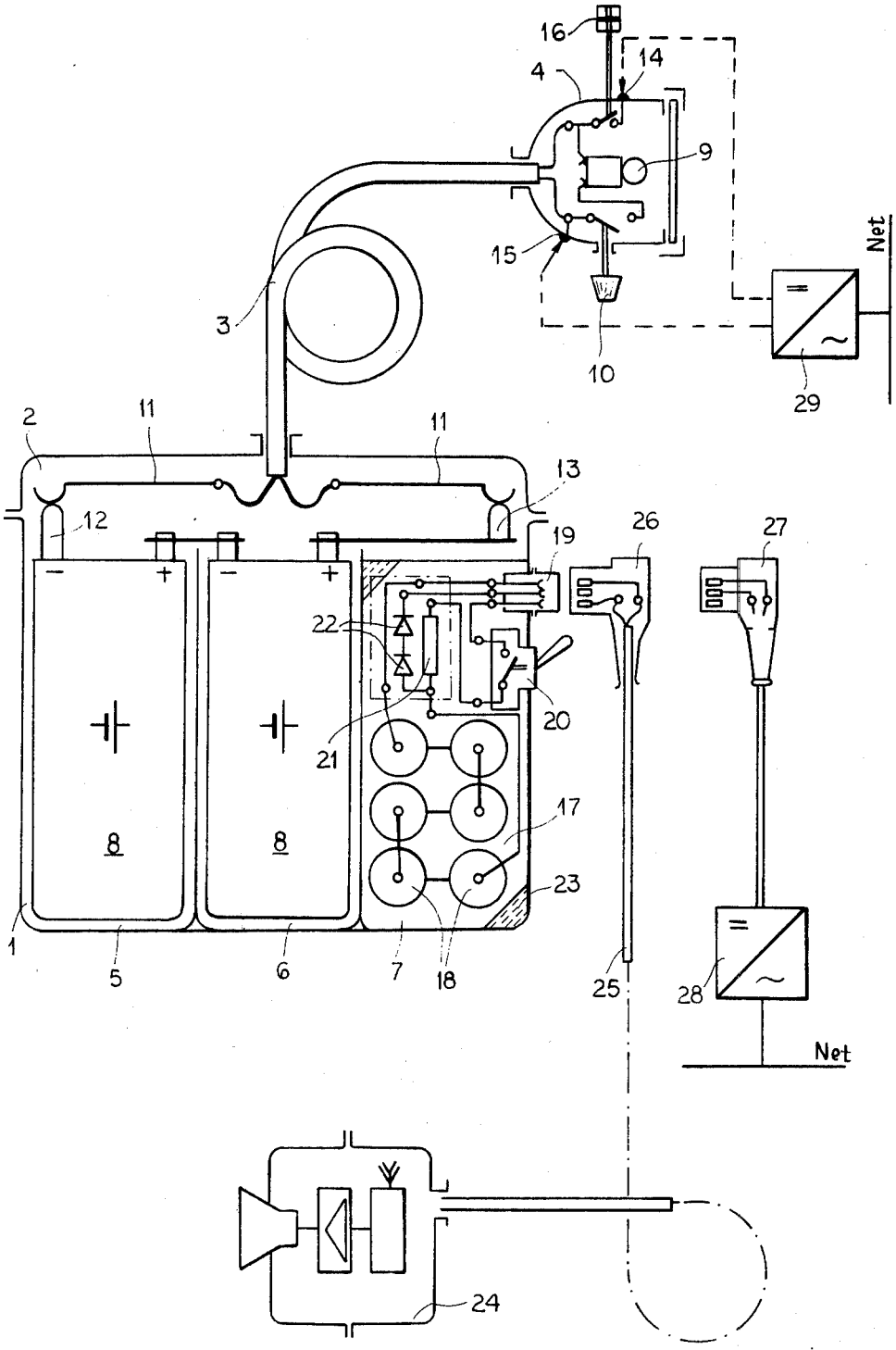
16
14
4
9
15
3
10
Net
29
2
11
11
13
12
19
26
27
22
20
21
17
8
8
23
1
5
6
7
18
25
28
Net
24

EXPLOSION-PROOF AND FIREDAMP-PROOF HEADLIGHT

CROSS REFERENCE TO RELATED APPLICATIONS

This application is a national phase application for PCT application PCT/DE 80/00023 filed March 1, 1980 and entitled to the priority of an application P 2909965.8-33 filed in the Federal Republic of Germany on March 14, 1979, the priority of which is claimed.

The present invention refers to an explosion-proof and/or firedamp-proof headlight consisting of a headpiece, a connection cable, a battery housing containing a plurality of replaceable accumulators (storage batteries), connecting means for additional electrically operated equipment as measuring instruments, radio communication equipment etc. which has a greatly extended range of application as a result of a special design expressly devised to accommodate said additions.

BACKGROUND OF THE INVENTION

Explosion-proof and firedamp proof headlights generally consist of a battery casing which is carried on a belt, a headpiece worn on the helmet and a cable connecting both. In most cases, the battery casing is designed for receiving two or three nickel-cadmium accumulators or lead accumulators and the headpiece is provided with a 2.4 to 3.75 V incandescent bulb. The accumulators are replaceably inserted into the compartments of the battery casing and serve exclusively for the purpose of lighting.

Headlights of this type are also known to accommodate sometimes other electrically operated equipment, such as two-way radio communicators, gas detectors, pagers, remote warning devices, dosimeters, dustproof helmets etc. by means of a special cable connecting them in an explosion-proof manner with the accumulators housed in the battery casing. This arrangement, however, has a number of disadvantages. First, the electrically operated units cannot be easily interchanged. Second, both lighting and accessories depend on a common source of electric supply as there is only one low-voltage current source available and therefore both circuits may break down in the event of a disturbance in only one of them. Furthermore, reasons of safety determine the need for costly protective devices to interrupt the flow of the current to the accessory in favor of the light should an accident occur and an overload threaten the battery.

The electric power required for the operation of the measuring instruments and communication equipment of the described type was hitherto provided by means of special explosion-proof and firedamp-proof batteries whose casing was equipped with plug connections for said accessories. These batteries, however, were extremely burdensome as they had to be carried in addition to the headlight batteries either hanging from the belt or in some other way. They were wired for automatic safety (had a socalled intrinsically safe output circuit). The prevailing standards of automatic safety for installation of this type (Sch)i require that the short-circuit output of an electric circuit or power supply located in an environment endangered by firedamp be limited to 12 W maximum. This means that in the event of a short-circuit, a current having a nominal potential of 12 V may flow at a maximum rate of 1 A. The battery is provided for this purpose with a protective wiring arrangement which controls the rate of discharge. It is also mandatory that both battery and protective safety wiring be encased. This, therefore, provides the intrinsically safe output circuit.

OBJECT OF THE INVENTION

The object of the instant invention is to provide an explosion-proof and/or firedamp proof headlight which will not only satisfy the demands of the art, but also provide a source of power for a discretionary choice of additional electrically operated accessory equipment.

SUMMARY OF THE INVENTION

This task is carried out by adding a supplementary battery to the battery housing and providing it with an automatic safety wiring (intrinsically safe output circuit) connected with a plug socket serving as an outlet in said battery housing.

According to the instant invention the battery housing contains two independent electric supply systems. First, the usual replaceable accumulators for lighting purposes and, second, a battery equipped with an intrinsically safe output circuit, which supplies power exclusively to the electrically operated accessories. The inherent ability of this additional battery to automatically regulate itself fully satisfies the pertinent safety regulations. Both the replaceable accumulators used for lighting and the self-regulated safety battery are rechargeable. The essential advantage resulting from this arrangement for the user is that he has to carry along one battery housing only, which supplies electric power for the headlight as well as for the electrically operated accessories.

The self-regulated safety battery consisting of a plurality of accumulator cells is together with its safety wiring, preferably embedded in a cast synthetic resin housing. Said battery housing is provided with a three-terminal plug socket, one terminal of which is directly connected with the positive pole of the self-regulated safety battery. The second and third terminals of the plug socket are connected with the negative pole of the self-regulated safety battery, the connection from the second terminal leading through a protective resistance and from the third terminal through blocking diodes. Between the protective resistance and the second pole of the plug socket there may be preferably a switch operable from the outside. The type of battery set most suitable for use in mines, would be the one consisting of a battery housing of three compartments containing two replaceable accumulators and one self-regulating safety battery.

BRIEF DESCRIPTION OF THE DRAWING

The sole FIGURE of the drawing is a diagram illustrating the invention.

SPECIFIC DESCRIPTION

The object of the present invention is illustrated in the drawing with the help of a typical example.

The explosion-proof and/or firedamp proof headlamp consists essentially of a battery housing 1 sealed with a lid 2, a connecting cable 3 and a headpiece 4. The battery housing has three compartments 5 through 7. In each of compartments 5 and 6 there is a replaceable accumulator or storage battery 8.

The incandescent bulb 9 in the headpiece 4 is operable by means of a switch 10. This bulb receives its electric power supply through contact springs 11 located in the lid 2 of the battery housing 1 which rest on contact pins 12 and 13. The accumulators 8 are charged through input contacts 14 and 15. The loss of electric power at said inlet contacts is prevented by means of a locked cut-off switch 16 which closes the charging circuit only when the headpiece is plugged into the battery charger 29.

The third compartment 7 of the battery housing 1 contains the self-regulating safety battery 17 consisting of a plurality of rechargeable accumulator cells 18. The lateral wall of the battery housing incorporates a plug socket 19. The upper plug contact of this socket is directly connected with the positive pole of the self-regulating safety battery 17. The lowest plug contact is used for the load and is connected through a switch 20 and a protective resistance 21 to the negative pole of said self-regulating safety battery. Finally, the center plug contact of the three-terminal socket 19 also leads to the negative pole of the self-regulating safety battery but the connection is routed through blocking diodes 22. The entire unit consisting of the self-regulating safety battery 17, the protective resistance 21, the switch 20 and the blocking diodes 22 is contained in the third compartment 7 of the battery housing 1 which is cast in a synthetic resin as an epoxy resin for instance. The characteristics of this unit fully satisfy the requirements of the pertinent safety regulations.

Added electrical equipment, for example a radio receiver 24, is connected by means of a cable 25 and a three-terminal plug 26 to the plug socket 19. The electric power is fed to the appliance through the extreme poles of the plug and the protective resistance 21 which limits the flow of the current forms part of the circuit. The appliance can be turned on and off by operating the switch 20.

To charge the self-regulated safety battery 17 it is connected to a battery charger 28 by means of a plug inserted into the socket 19. The feeding current runs through the upper and center poles. The blocking diodes 22 prevent any discharge through the center pole.

The instant invention is by no means limited to the example provided. Without overstepping its limits it can be the object of great many variations. For instance, the battery housing 1 could hold any number of replaceable accumulators 8 and/or self-regulated safety batteries. Furthermore, the design of the socket 19 and of the plug 26, 27 could be different. In lieu of a socket 19 installed directly on the battery housing, a cable could be provided with a female plug or the coupling could take place by means of cable connectors. It is equally possible to eliminate the switch 20 and use other components to provide the automatic safety feature.

We claim:

1. An explosion-proof and firedamp-proof headlamp, e.g. for mines or the like, comprising in combination:

a headpiece provided with at least one incandescent lamp;

a connecting cable running to said headpiece and including conductors connected to said incandescent lamp;

a belt-supported battery housing, said battery housing being formed with a plurality of compartments;

a lamp battery replaceable in one of said compartments, said housing being provided with circuitry for connecting the conductors of said cable to said lamp battery;

an additional battery having an intrinsically safe output circuit received in another compartment of said housing and electrically isolated from said circuitry and from said cable for supplying energy for an electrically operated unit such as an instrument or radio; and a socket mounted in a wall of said housing and accessible from a location externally thereof, said socket having terminals electrically connected to said additional battery.

2. The headlamp defined in claim 1 wherein said additional battery comprises a plurality of cells embedded in a synthetic resin cast in said housing, said output circuit being also embedded in synthetic resin.

3. The headlamp defined in claim 6 wherein said circuit has three terminals including a first terminal connected directly to the positive pole of said additional battery, a second terminal connected to the negative pole of said battery through a protective resistance, and a third terminal connected to the negative pole of said additional battery through at least one blocking diode.

4. The headlamp defined in claim 3, further comprising a switch extending from said housing and operable from the exterior thereof, connected in circuit between said protective resistance and said second terminal of said circuit.

5. The headlamp defined in claim 3 wherein said housing contains three battery compartments, and a further replaceable battery connectable to said circuitry and said cable.

* * * * *